US011661741B2

(12) United States Patent
Hun et al.

(10) Patent No.: US 11,661,741 B2
(45) Date of Patent: May 30, 2023

(54) NON-CORRODING STRIPPING LIFTING INSERTS FOR PRECAST INSULATED PANELS

(71) Applicants: UT-BATTELLE, LLC, Oak Ridge, TN (US); University of Tennessee Research Foundation, Knoxville, TN (US)

(72) Inventors: Diana Hun, Lenoir City, TN (US); Uday K. Vaidya, Knoxville, TN (US); Stephen W. Sheriff, Friendsville, TN (US); Dylan M. Talley, Oak Ridge, TN (US); Nolan W. Hayes, Jefferson City, TN (US); Zhongguo John Ma, Knoxville, TN (US)

(73) Assignees: UT-BATTELLE, LLC, Oak Ridge, TN (US); UNIVERSITY OF TENNESSEE RESEARCH FOUNDATION, Knoxville, TN (US)

( * ) Notice: Subject to any disclaimer, the term of this patent is extended or adjusted under 35 U.S.C. 154(b) by 331 days.

(21) Appl. No.: 17/187,044

(22) Filed: Feb. 26, 2021

(65) Prior Publication Data

US 2021/0262227 A1 Aug. 26, 2021

Related U.S. Application Data

(60) Provisional application No. 62/981,677, filed on Feb. 26, 2020.

(51) Int. Cl.
*E04C 2/288* (2006.01)
*E04G 21/14* (2006.01)
(Continued)

(52) U.S. Cl.
CPC ..... *E04C 2/288* (2013.01); *B28B 23/005* (2013.01); *E04C 2/044* (2013.01); *E04G 21/147* (2013.01); *E04C 2002/002* (2013.01)

(58) Field of Classification Search
CPC .... E04C 2/288; E04C 2/044; E04C 2002/002; B28B 23/005; E04G 21/147
(Continued)

(56) References Cited

U.S. PATENT DOCUMENTS 3,115,726 A * 12/1963 Sayles ..... E04F 21/05 404/136
3,420,014 A * 1/1969 Courtois ..... E04B 1/4142 52/125.4
(Continued)

FOREIGN PATENT DOCUMENTS

AU 2009100142 A4 * 3/2009 ..... B28B 23/005
DE 2802121 A1 * 7/1978 ..... B28B 23/005
(Continued)

*Primary Examiner* — Michael Safavi
(74) *Attorney, Agent, or Firm* — Fox Rothschild LLP

(57) ABSTRACT

A stripping lifting insert is provided for precast insulated panels having an insulating material layer between opposing wythes, the insulating material layer, wythes, and precast insulated panel having respective widths. The stripping lifting insert includes an elongated connecting shaft having a shaft axis. First and second spaced apart wythe engagement members are connected to the connecting shaft in spaced apart relation to each other. Each wythe engagement member includes a hub and a plurality of three or more protrusions connected to and emanating from hub. Each of the protrusions extending radially outward from the shaft axis. The wythe engagement members have a height less than the width of the wythes, whereby each wythe engagement member can be completely embedded in a respective
(Continued)

wythe of the precast insulated panel. A precast insulated panel and a method of making a precast insulated panel are also disclosed.

31 Claims, 10 Drawing Sheets

(51) Int. Cl.
*B28B 23/00* (2006.01)
*E04C 2/04* (2006.01)
*E04C 2/00* (2006.01)

(58) Field of Classification Search
USPC ..... 52/687, 688, 689, 125.1, 125.2, 125.4, 52/125.5
See application file for complete search history.

(56) References Cited

U.S. PATENT DOCUMENTS 3,431,012 A * 3/1969 Eriksson ..... B28B 23/005 52/125.4
4,000,591 A * 1/1977 Courtois ..... E04G 21/142 52/707
4,017,115 A * 4/1977 Holt ..... E04G 15/061 411/21
4,074,499 A * 2/1978 Mess ..... E04B 1/4121 52/705
4,204,711 A * 5/1980 Lancelot, III ..... B66C 1/666 52/125.1
4,580,378 A * 4/1986 Kelly ..... E04G 21/142 52/125.4
4,660,344 A * 4/1987 Gaudelli ..... B28B 23/005 52/592.1
5,014,473 A * 5/1991 Kelly ..... E04G 21/142 294/82.35
5,058,348 A * 10/1991 Westhed ..... E04F 21/05 52/126.6
6,341,452 B1 * 1/2002 Bollinghaus ..... E04G 21/142 294/90
8,875,471 B2 * 11/2014 Siqueiros ..... E04B 1/3511 52/707
11,421,431 B1 * 8/2022 Jablonsky ..... E04C 2/288
2010/0037536 A1 * 2/2010 Schulze ..... B28B 23/005 52/125.4
2015/0284967 A1 * 10/2015 Kim ..... E04C 5/125 52/125.4
2016/0244986 A1 * 8/2016 Atkinson ..... E04F 21/18
2018/0023296 A1 * 1/2018 Recker ..... E04G 21/147 52/126.6

FOREIGN PATENT DOCUMENTS

EP 3736389 A1 * 11/2020 ..... E04B 1/4157
FR 1563919 A * 4/1969 ..... B28B 23/005
FR 2491529 A1 * 4/1982 ..... B28B 23/005
FR 2543481 A * 10/1984 ..... B28B 23/005
FR 2574697 A2 * 6/1986 ..... B28B 23/005
FR 2926576 A1 * 7/2009 ..... B28B 23/005
FR 2978468 A1 * 2/2013 ..... E04C 2/044
FR 3112566 A1 * 1/2022 ..... E04C 2002/002
GB 1250008 A * 10/1971 ..... B28B 23/005
GB 1356987 A * 6/1974 ..... E04C 2/041
KR 2018078615 A * 7/2018 ..... B28B 23/005
WO WO-2004001147 A2 * 12/2003 ..... E04C 2/044
WO WO-2012129177 A1 * 9/2012 ..... B28B 23/005

* cited by examiner

NON-CORRODING STRIPPING LIFTING INSERTS FOR PRECAST INSULATED PANELS

CROSS-REFERENCE TO RELATED APPLICATIONS

This application claims priority to U.S. Provisional Patent Application No. 62/981,677 filed on Feb. 26, 2020, entitled "NON-CORRODING STRIPPING LIFTING INSERTS FOR PRECAST CONCRETE", the entire disclosure of which incorporated herein by reference.

STATEMENT REGARDING FEDERALLY SPONSORED RESEARCH AND DEVELOPMENT

This invention was made with government support under Contract No. DE-AC05-00OR22725 awarded by the U.S. Department of Energy. The government has certain rights in this invention.

FIELD OF THE INVENTION

The present invention relates generally to precast insulated panels, and more particularly to an apparatus for removing precast insulated panels from molds and formwork.

BACKGROUND OF THE INVENTION

Precast insulated panels have become popular in construction for variability of design and efficiency of manufacture. Precast insulated panels are typically constructed in molds or formwork by pouring a first concrete panel or wythe, positioning an insulating panel on top of the wythe, and pouring a second concrete panel or wythe. Such panels must be transported to the installation site, and as the panels can be quite large, in some cases as large as 12'×60' and weighing thousands of pounds, removing the panels from the mold can provide challenges. For this reason, stripping inserts are utilized. Cables from lifting devices such as cranes are attached to the stripping lifting inserts to provide engagement points for the cables. Such stripping lifting inserts must be quite strong, however, due to the dimensions of the panels, where the wythes may be no more than several inches thick, the stripping lifting inserts cannot be so large as to protrude and interfere with the visual aesthetics of the precast insulated panel. Such stripping lifting inserts must also preferably be corrosion resistant.

SUMMARY OF THE INVENTION

A stripping lifting insert is provided for precast insulated panels having an insulating material layer between opposing wythes. The insulating material layer, wythes, and precast insulated panel have respective widths. The stripping lifting insert includes an elongated connecting shaft having a shaft axis, and first and second spaced apart wythe engagement members connected to the connecting shaft in spaced apart relation to each other. Each wythe engagement member includes a hub and a plurality of three or more protrusions connected to and emanating from the hub. Each of the protrusions extends radially outward from the shaft axis. The wythe engagement members have a height less than the width of the wythes, whereby each wythe engagement member can be embedded in a respective wythe of the precast insulated panel.

The position of the wythe engagement members on the shaft is adjustable. The hubs of the wythe engagement members have a threaded interior opening, and an outside surface of the shaft is cooperatively threaded such that the wythes can be engaged to the threaded shaft. The position of the wythe engagement members on the threaded shaft can be adjusted by threading the wythe engagement members along the length of the shaft. The interior thread can be at least one selected from the group consisting of triangular or trapezoidal threads.

The stripping lifting insert can further include lift engagement structure secured to an end of the shaft for engaging a stripping lifting device. The lift engagement structure can be threaded and an end of the shaft is cooperatively threaded.

The plurality of protrusions can be four equally spaced about the circumference of the hub. The four protrusions can be arranged in a cross configuration.

The wythe engagement members can be made from a fiber-reinforced polymer. The fiber-reinforced polymer can include discontinuous fibers in a polymer matrix. The fiber-reinforced polymer can include, in the polymer matrix, continuous fibers and discontinuous fibers. The lengths of the discontinuous fibers can be in a range of 0.2" to 2". The fiber-reinforced polymer can include at least one selected from the group consisting of glass fibers, carbon fibers, aramid fibers, basalt fibers, and combinations thereof. The polymer matrix can include at least one selected from the group consisting of thermoplastic polyphenylene sulfide, polyethylene terephthalate, polyamide, polyurethane, polysulfone, polyether ketone, polyetherether ketone, thermoset epoxy, phenolic, vinyl ester and polyester.

The height of the stripping lifting insert along the shaft axis can be in a range of 0.75" to 1.25". A radial extension of each protrusion of the plurality of protrusions can be in a range of 2" to 8". A height of each protrusion of the plurality of protrusions along the shaft axis can be in a range of from 1/16" to 1/4". A width of each protrusion of the plurality of protrusions orthogonal to a radial direction can be in a range of from 0.5" to 1.5". A diameter of the shaft can be in a range of from 0.5" to 1.5".

Each protrusion of the plurality of protrusions can include respective ribs extending radially away from the hub. Each rib can extend over 25% to 75% of the radial extension, and can have a width of 20% to 60% of the width of the corresponding protrusion.

A precast insulated panel can include an insulating material layer and opposing wythes on each side of the insulating material layer, the insulating material layer, wythes, and precast insulated panel having respective widths. A stripping lifting insert includes an elongated connecting shaft having a shaft axis, and first and second spaced apart wythe engagement members connected to the shaft in spaced apart relation to each other. Each wythe engagement member includes a hub and a plurality of three or more protrusions connected to and distributed around the hub. Each of the protrusions extends radially outward from the shaft axis. The wythe engagement members have a height less than the width of the wythes, whereby each wythe engagement member can be embedded in a respective wythe of the precast insulated panel. The connecting shaft can have a length greater than the width of the precast insulated panel such that a connecting end of the connect shaft will protrude from one of the wythes.

A method of making a precast insulated panel having an insulating material layer between opposing wythes can include the steps of providing a stripping lifting insert comprising an elongated connecting shaft having a shaft axis, and first and second spaced apart wythe engagement members connected to the shaft in spaced apart relation to each other. Each wythe engagement member includes a hub and a plurality of three or more protrusions connected to and distributed around the hub. Each of the protrusions extends radially outward from the shaft axis, wherein the wythe engagement members have a height less than the width of the wythes. Each wythe engagement member can be embedded in a respective wythe of the precast insulated panel, and the connecting shaft can have a length greater than the width of the precast insulated panel such that a connecting end of the connect shaft will protrude from one of the wythes.

A mold is provided for the precast insulated panel. A first wythe engagement member is placed into the mold. Concrete constituting a portion of a first wythe is poured into the mold such that the wythe engagement member is embedded within the concrete of the first wythe and the connecting shaft protrudes from the wythe. An insulation material layer is placed over the wythe with the connecting shaft protruding from the insulation material layer. A second wythe engagement member is positioned onto the connecting shaft. Concrete constituting a second wythe is poured over the insulation material layer, with a second wythe engagement member embedded within the second wythe, and the connecting shaft protruding from the second wythe, to form a precast insulated panel. A lifting device is connected to the elongated connecting shaft protruding from the second wythe, and the precast insulated panel is lifted from the mold.

BRIEF DESCRIPTION OF THE DRAWINGS

There are shown in the drawings embodiments that are presently preferred it being understood that the invention is not limited to the arrangements and instrumentalities shown, wherein:

FIG. 8 A is an enlargement of area 8A in FIG. 8.

FIG. 10 A is an enlargement of area 10 A in FIG. 10.

FIG. 11 A is a cross-section of the first wythe engagement member in the first mode of operation.

FIG. 12 A is a cross-section of a first wythe engagement member in a $2^{nd}$ mode of operation.

DETAILED DESCRIPTION OF THE INVENTION

Figure 1:
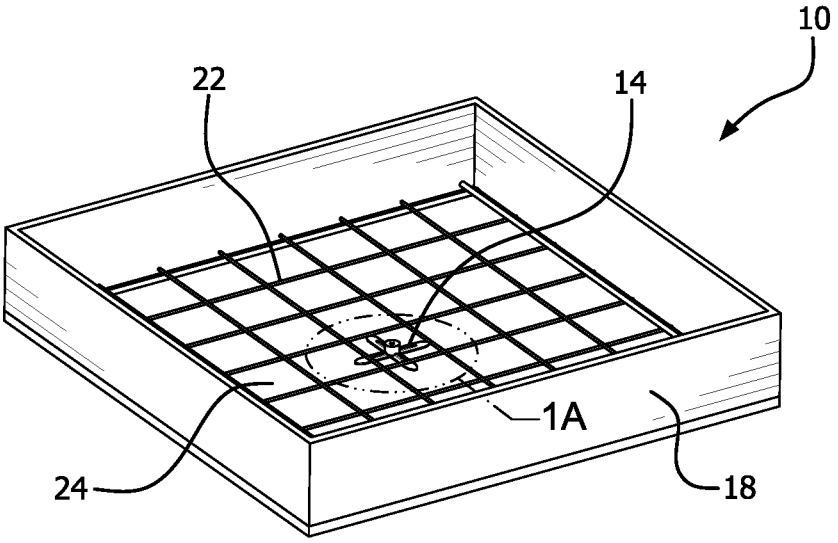
FIG. 1 is a perspective view of a precast insulated panel in a first stage of construction.

A stripping lifting insert is provided for precast insulated panels having an insulating material layer between opposing wythes, the insulating material layer, wythes, and precast insulated panel having respective widths. The stripping lifting insert includes an elongated connecting shaft having a shaft axis. First and second spaced apart wythe engagement members are connected to the connecting shaft in spaced apart relation to each other. Each wythe engagement member includes a hub and a plurality of three or more protrusions connected to and emanating from the hub. The wythe engagement members have a height less than the width of the wythes, whereby each wythe engagement member can be embedded in a respective wythe of the precast insulated panel.

The position of the wythe engagement members on the shaft is adjustable. The hubs of the wythe engagement members can have a threaded interior opening, and an outside surface of the shaft is cooperatively threaded such that the wythes can be engaged to the threaded shaft, and the position of the wythe engagement members on the threaded shaft can be adjusted by threading the wythe engagement members along the length of the shaft. The interior thread can be at least one selected from the group consisting of triangular or trapezoidal threads.

The stripping lifting insert can further include stripping lift engagement structure secured to an end of the shaft for engaging a stripping lifting device. The stripping lift engagement structure can be any suitable structure. The stripping lift engagement structure can be threaded and an end of the shaft can be cooperatively threaded to engage the stripping lift engagement structure.

The plurality of protrusions can have different numbers, sizes, thicknesses and widths, depending in part of the size and weight of the precast insulated panel. The plurality of protrusions can comprise four equally spaced protrusions about the circumference of the hub. The four protrusions can be arranged in a cross configuration.

The stripping lifting insert of the invention can be made of different materials, but preferably are corrosion resistant and possess the strength to lift the precast panel from the mold or formwork. The wythe engagement members can be made from a fiber-reinforced polymer. The fiber-reinforced polymer can comprise discontinuous fibers in a polymer matrix. The fiber-reinforced polymer can also include, in the polymer matrix, continuous fibers and discontinuous fibers. The dimensions of the discontinuous fibers can vary. In one embodiment, the lengths of the discontinuous fibers are in a range of 0.2" to 2".

The fiber-reinforced polymer comprises fibers made from a suitable material. The fibers can be at least one selected from the group consisting of glass fibers, carbon fibers, aramid fibers, basalt fibers, and combinations thereof. Other fiber materials are possible. The fibers are dispersed in a polymer matrix. The polymer matrix can be a variety of different materials. The matrix material can be at least one selected from the group consisting of thermoplastic polyphenylene sulfide, polyethylene terephthalate, polyamide, polyurethane, polysulfone, polyether ketone, polyetherether ketone, thermoset epoxy, phenolic, vinyl ester and polyester. Other matrix materials are possible.

The protrusions can have varying sizes and shapes, but in general will have elongated portions which become embedded in and engage the wythes. In one embodiment, the height of the hub is greater than the height of the protrusions, such that the hub can be flush with the surface of the wythe while protrusions remain embedded in the wythe, to facilitate connection of the shaft to the wythe engagement members. Each of the protrusions extends radially outwardly from the shaft axis, and can be perpendicular or within any range of ±25 degrees of perpendicular to the shaft axis.

Each protrusion of the plurality of protrusions comprises respective ribs extending radially away from the hub. Each rib can extend over 25% to 75% of the radial extension of the protrusion. Each rib can extend 25%, 30%, 35%, 40%, 45%, 50%, 55%, 60%, 65%, 70%, or 75%, and can be within a range of any high value and low value selected from these values. The ribs can have a width of 20% to 60% of the width of the corresponding protrusion. The ribs can have a width of 20%, 25%, 30%, 35%, 40%, 45%, 50%, 55%, or 60% of the width of the corresponding protrusion, and can be within a range of any high value and low value selected from these values.

The stripping lifting insert can have different dimensions depending on the particular installation and particularly the dimensions and weight of the precast insulated panel for which it is intended. These panels can have very significant dimensions, for example 10-12 feet in height and 20-60 feet in length. In one aspect, a height of the stripping lifting insert along the shaft axis is in a range of 0.75" to 1.25". A radial extension of each protrusion of the plurality of protrusions can be in a range of 2" to 8". A height of each protrusion of the plurality of protrusions along the shaft axis can be in a range of from 1/16" to 1/4". A width of each protrusion of the plurality of protrusions orthogonal to a radial direction can be in a range of from 0.5" to 1.5". A diameter of the connecting shaft can be in a range of from 0.5" to 1.5". Other dimensions are possible.

A precast insulated panel can be provided in which one of the first and second wythe engagement members is embedded in a respective one of the first and second wythes of the precast insulated panel, and connected by the connecting shaft. The connecting shaft can have secured thereto the lift engagement structure.

A method of making a precast insulated panel having an insulating material layer between opposing wythes can include the step of providing a stripping lifting insert. The stripping lifting insert includes an elongated connecting shaft having a shaft axis, and first and second spaced apart wythe engagement members connected to the shaft in spaced apart relation to each other. Each wythe engagement member comprises a hub and a plurality of three or more protrusions connected to and distributed around the hub. Each of the protrusions extends radially outward from the shaft axis, wherein the wythe engagement members have a height less than the width of the wythes, whereby each wythe engagement member can be embedded in a respective wythe of the precast insulated panel. The connecting shaft has a length greater than the width of the precast insulated panel such that a connecting end of the connecting shaft will protrude from one of the wythes.

A mold or formwork for the precast insulated panel is provided. Concrete constituting a portion of a first wythe is placed into the mold. A first wythe engagement member is placed into the mold. A remainder of the concrete constituting the first wythe can then be poured, embedding the first wythe engagement member with the connecting shaft protruding. The protrusions are embedded within the concrete. The first wythe engagement member should have concrete underneath it. Other methods of construction are possible.

An insulation material layer is then positioned over the wythe with the connecting shaft protruding from the insulation material layer. A second wythe engagement member is attached to the connecting shaft. Concrete constituting a second wythe is poured over the insulation material layer, with the second wythe engagement member embedded within the second wythe, and the connecting shaft protruding from the second wythe, to form a precast insulated panel. Stripping lifting engagement structure can be connected to the elongated connecting shaft protruding from the second wythe, and the precast insulated panel can be lifted from the mold by a suitable lifting device such as a crane.

Figure 1A:
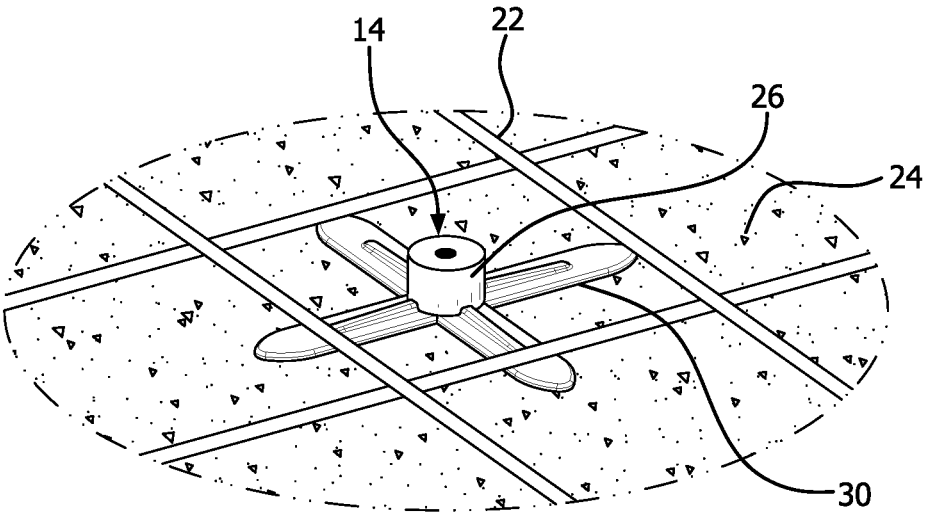
FIG. 1A is an expanded view of area 1A in FIG. 1.

There is shown in FIGS. 1-14 a precast insulated panel assembly system 10 and method in which a stripping lifting insert according to the invention is positioned in a mold 18 used to make the precast insulated panel. A first wythe engagement member 14 can be positioned in the mold on an initial concrete portion of a first wythe 24 and optionally rebar 22 can be included. As shown in FIG. 1A, the first wythe engagement member 14 is comprised by a hub 26 and a plurality of radially extending protrusions 30.

Figure 2:
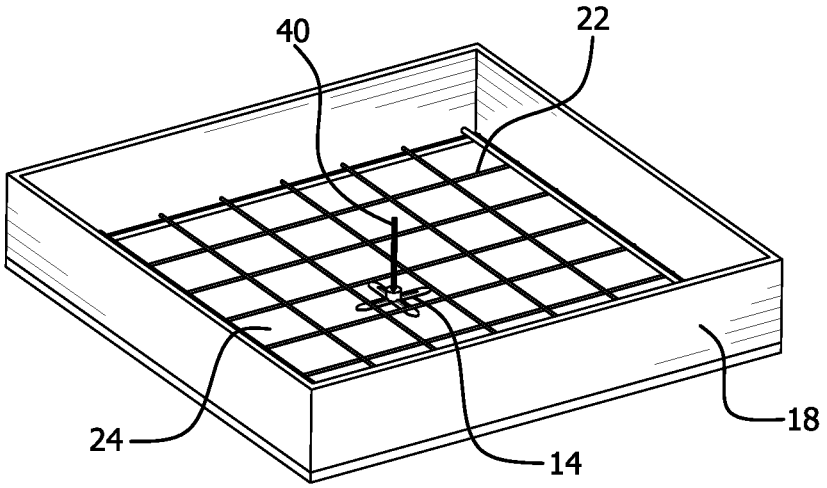
FIG. 2 is a perspective view of a precast insulated panel in a $2^{nd}$ stage of construction.
Figure 3:
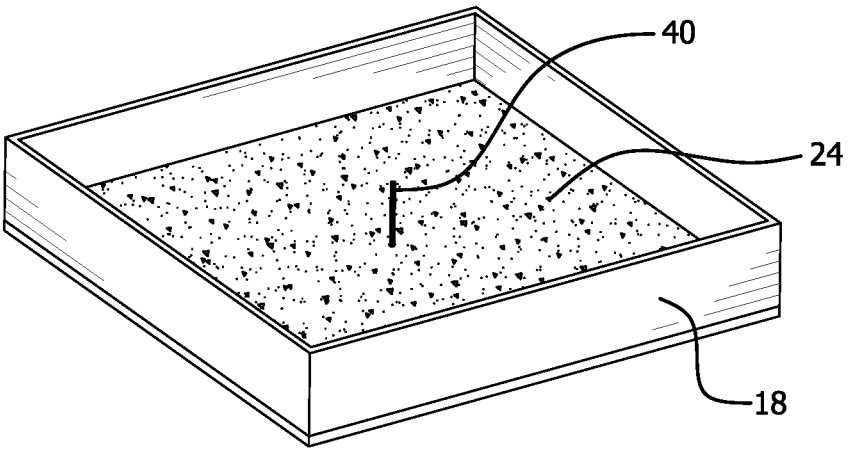
FIG. 3 is a perspective view of a precast insulated panel in a $3^{rd}$ stage of construction.

As shown in FIG. 2 a connecting shaft 40 can be secured to the hub 26 by suitable structures such as cooperating threads. A remaining portion of concrete wythe 24 is then poured so as to embed the first wythe engagement member 14, leaving a portion of the connecting shaft 40 extending from the first wythe 24 (FIG. 3).

Figure 4:
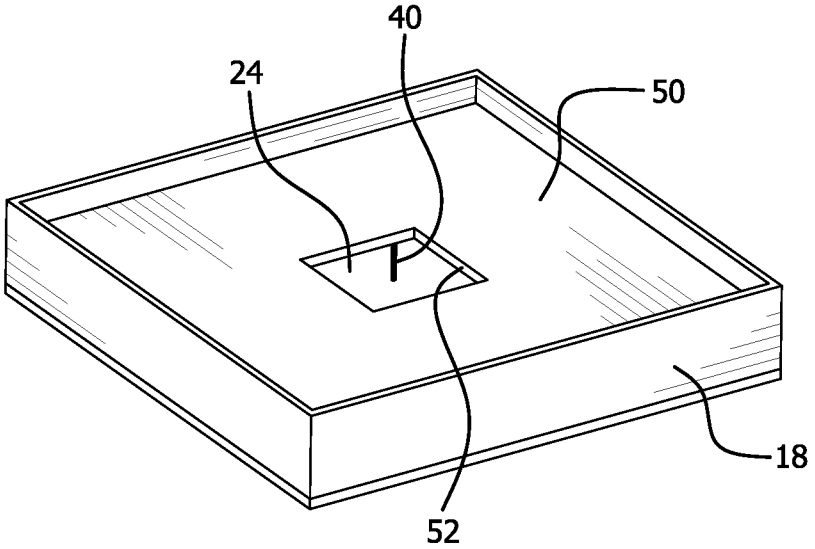
FIG. 4 is a perspective view of a precast insulated panel in a $4^{th}$ stage of construction.
Figure 5:
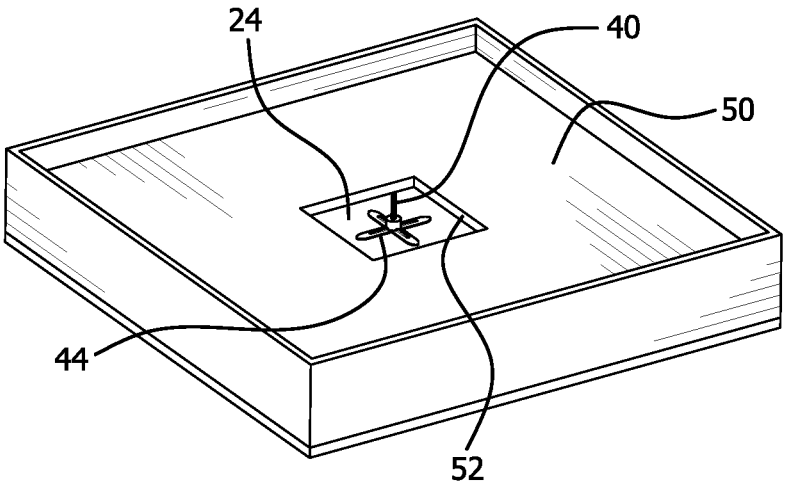
FIG. 5 is a perspective view of a precast insulated panel in a $5^{th}$ stage of construction.
Figure 6:
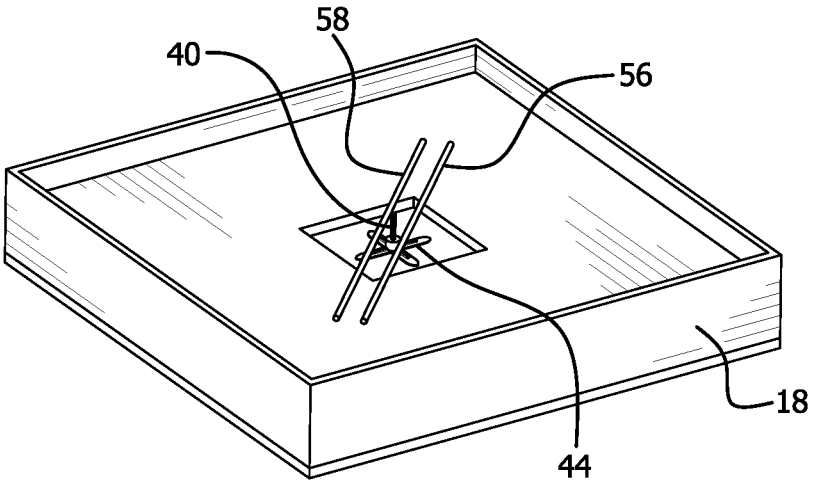
FIG. 6 is a perspective view of a precast insulated panel in a $6^{th}$ stage of construction.
Figure 7:
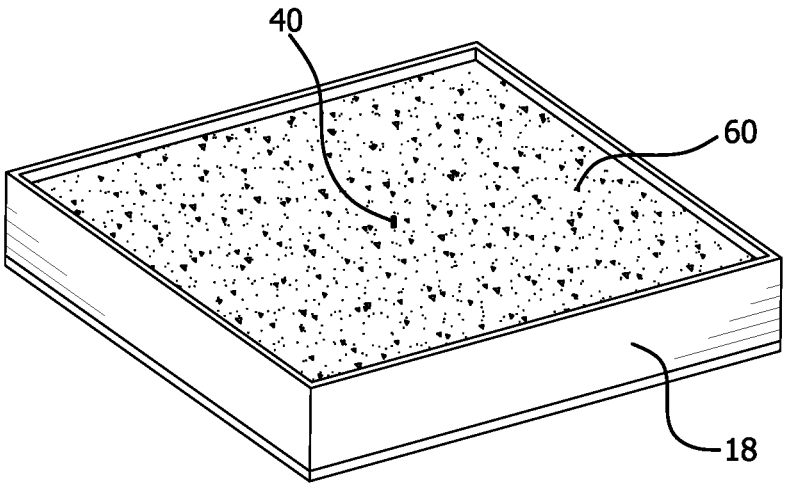
FIG. 7 is a perspective view of a precast insulated panel in a $7^{th}$ stage of construction.

An insulation layer 50 is then positioned in the mold 18 onto the first wythe 24 (FIG. 4). The insulation layer 50 can have a cut out portion 52. A second wythe engagement member 44 can then be threaded onto the connecting shaft 40 and placed on the first wythe 24 within the cut out portion 52 (FIG. 5). Optionally rebar 56 and 58 which can be fiber-reinforced polymer can be positioned over the second wythe engagement member 44 to provide additional engagement to a second wythe and added strength during the stripping lifting procedure (FIG. 6). A second concrete wythe 60 can then be poured (FIG. 7). The end portion of the connecting shaft 40 will extend out of the second concrete wythe 60.

Figure 8:
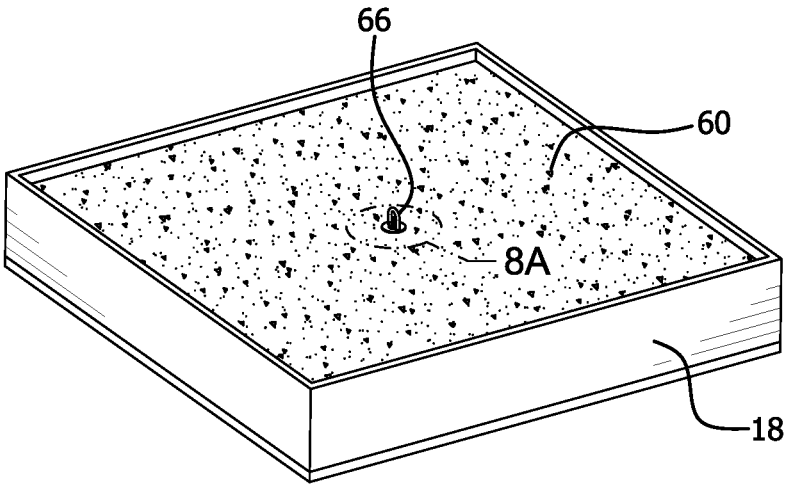
FIG. 8 is a perspective view of a precast insulated panel in an 8th stage of construction.
Figure 8A:
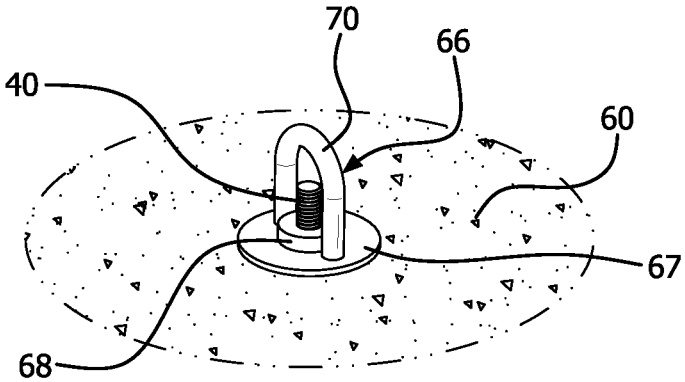
Figure 9:
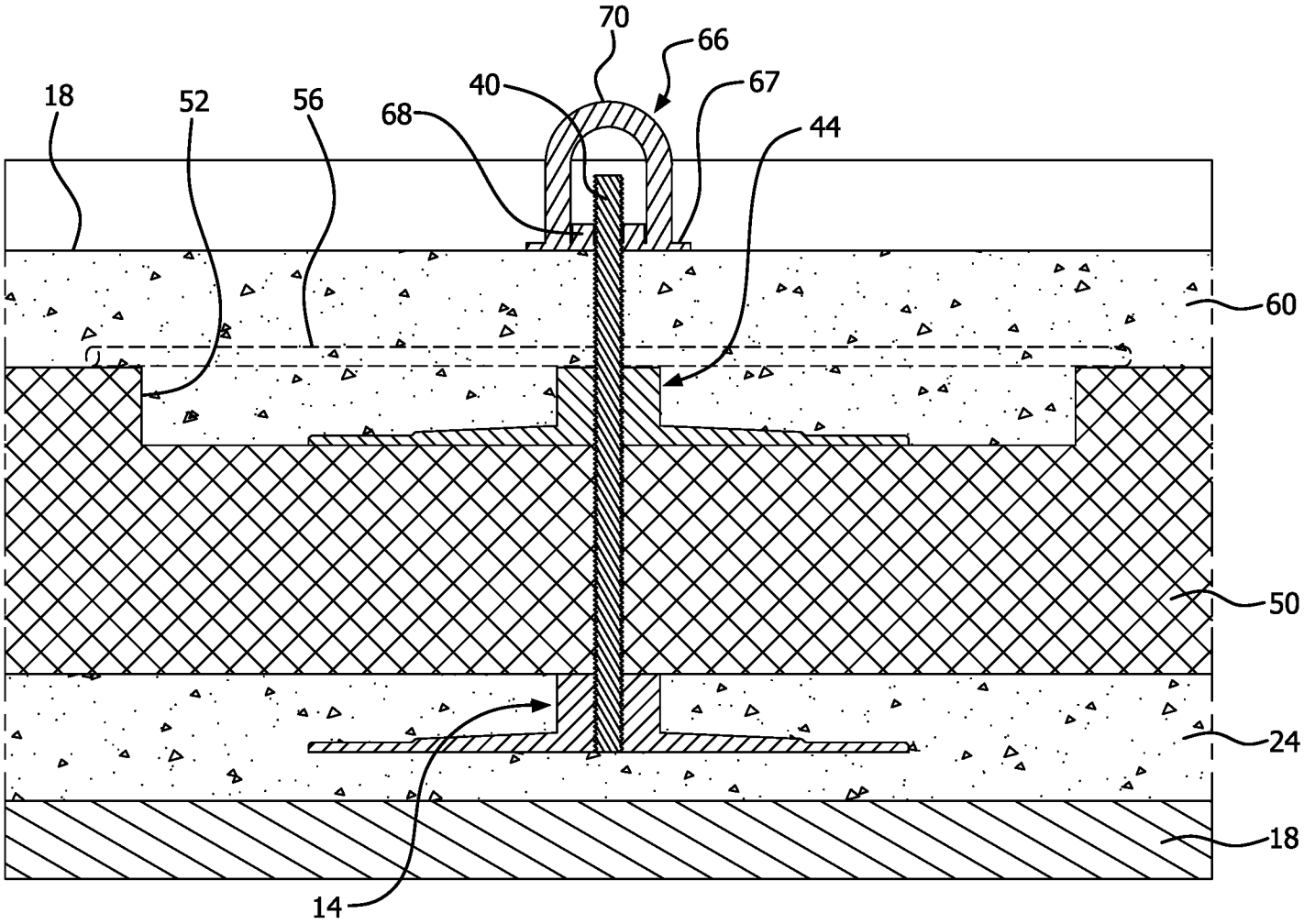
FIG. 9 is a perspective view of a precast insulated panel in a $9^{th}$ stage of construction.
Figure 10:
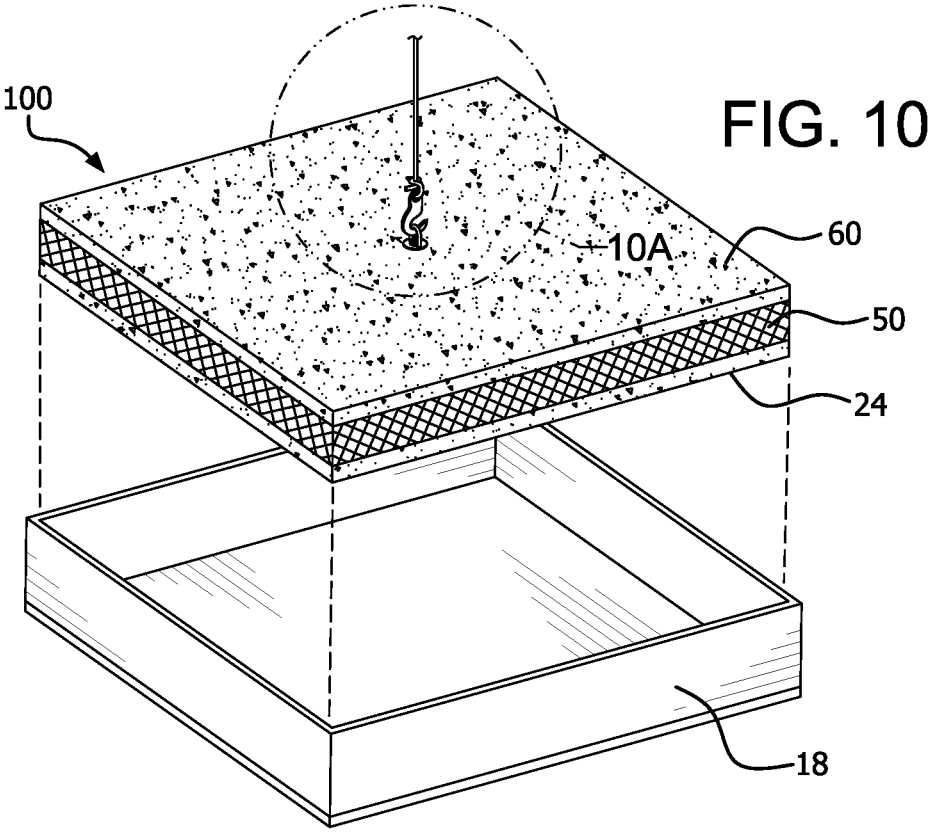
FIG. 10 is a cross-section of a precast insulated panel.
Figure 10A:
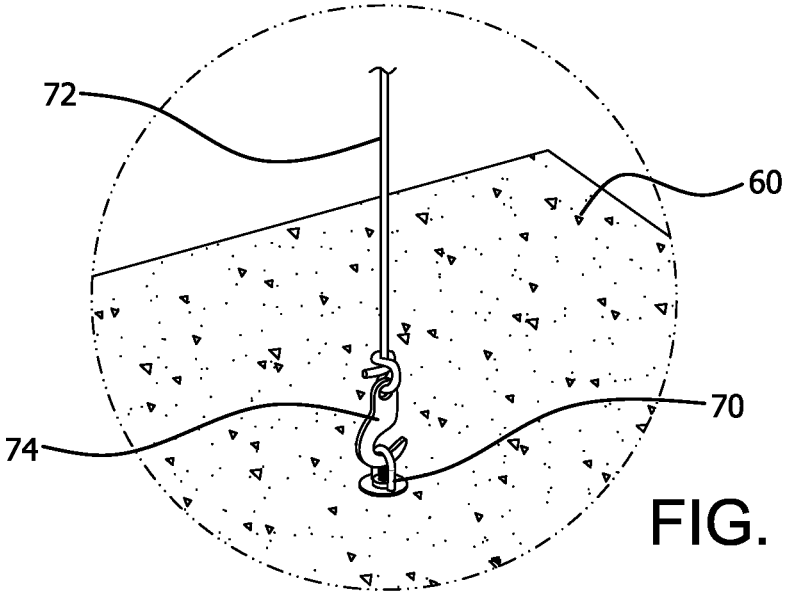
Figure 11:
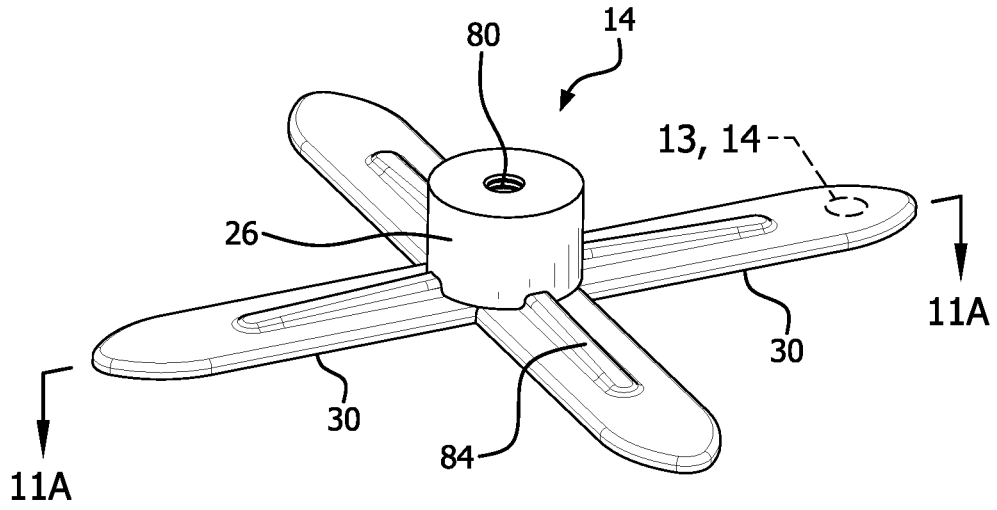
FIG. 11 is a perspective view of a first wythe engagement member the first mode of operation.
Figure 12:
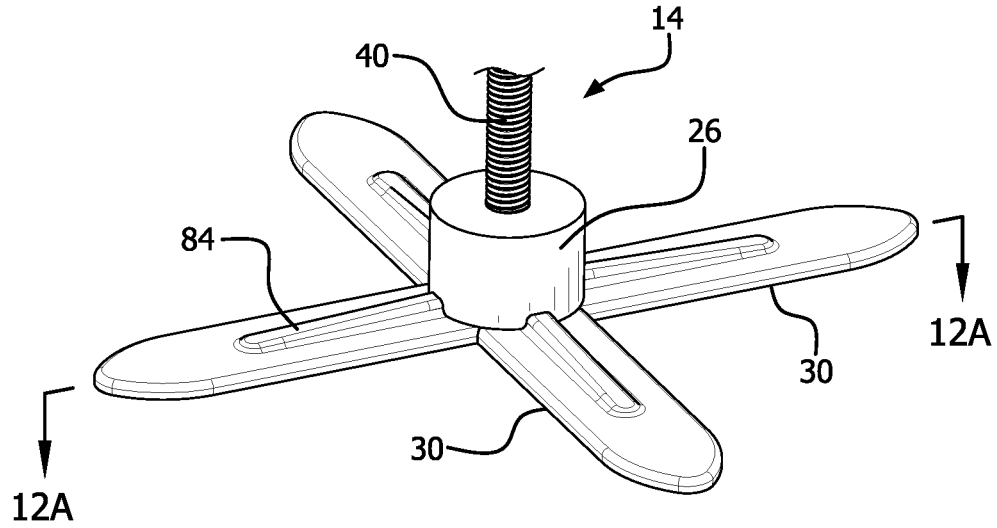
FIG. 12 is a perspective view of a first wythe engagement member in a $2^{nd}$ mode of operation.
Figure 11A:
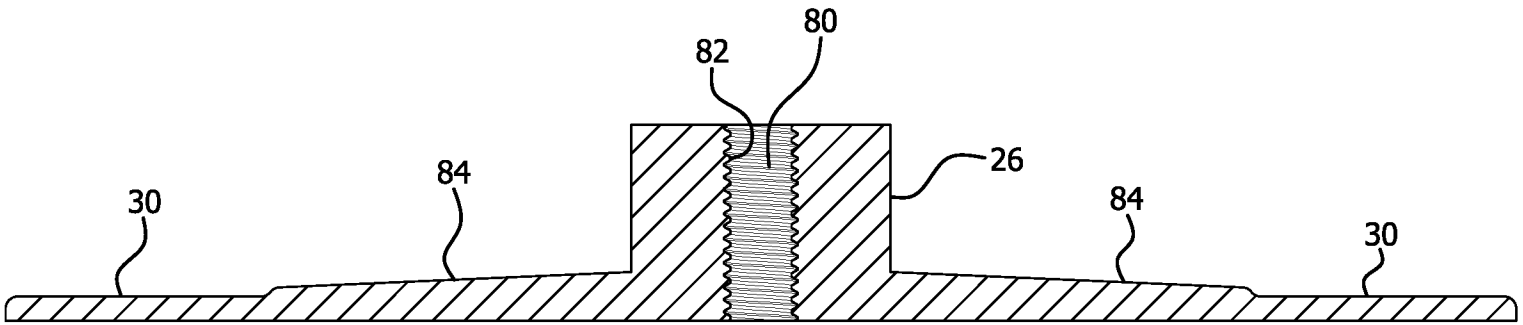
Figure 12A:
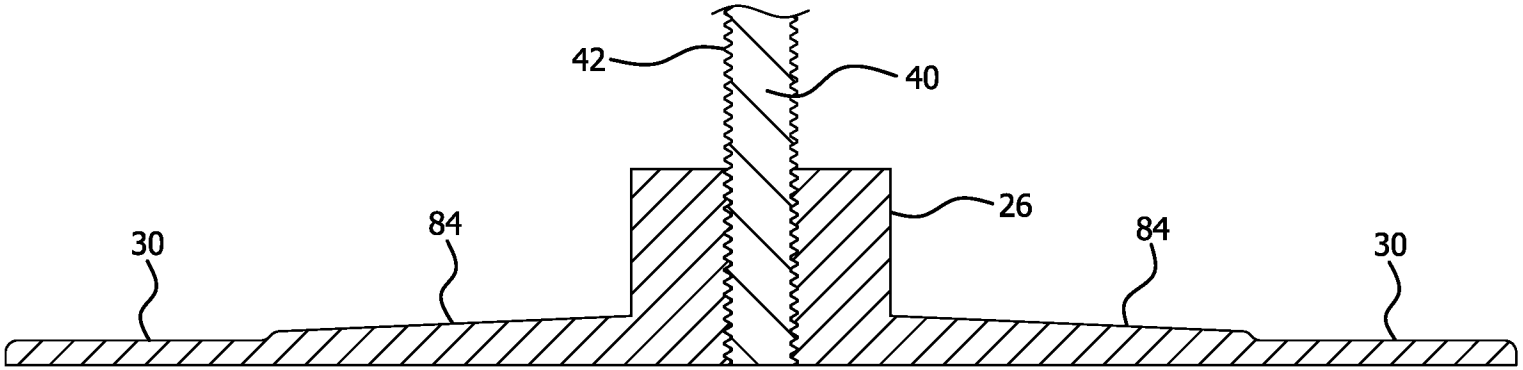

Stripping lift engagement structure 66 can be secured to the end portion of the connecting shaft 40 extending from the second concrete wythe 60. The stripping lifting engagement structure 66 can take many forms, but in the embodiment shown in FIG. 8A includes a base 67, a connecting nut 68 for engaging the connecting shaft 40, and a U-shaped portion for connecting to a stripping lifting device. As shown in FIG. 9, the first wythe engagement member 14 is embedded in the first wythe 24, and the second wythe engagement member 44 is embedded in the second wythe 60. As the stripping lifting device applies a lifting force to the stripping lifting engagement structure 66, the first wythe 24 and second wythe 60 will be simultaneously acted upon by the respective first wythe engagement member 14 and second wythe engagement member 44 through the connecting shaft 40. Rebar 56 and 58 will provide additional strength. As shown in FIG. 10, the stripping lifting device such as a crane is used to lift the completed precast insulated panel 100 from the mold 18. In the embodiment shown in FIG. 10 A, the crane includes a lifting cable 72 and hook 70 used to engage the U-shaped portion 70 of the stripping lifting engagement structure 66. The invention can be used with other kinds of stripping lifting devices.

As shown in FIGS. 11-11A and FIGS. 12-12A, the wythe engagement members such as the first wythe engagement member 14 can have additional structure for strengthening these members. Such structure can be radially extending ribs 84 on the protrusions 30. Also, the manner of connecting the connecting shaft 42 the wythe engagement members can vary but in the embodiment shown the connecting shaft 40 has threads 42 which engage cooperating threads 82 in a threaded opening 80 in the hub 26. In this manner, each wythe engagement member can be axially adjustable on the connecting shaft 40 by rotation of the wythe engagement member on the connecting shaft 40.

Figure 13:
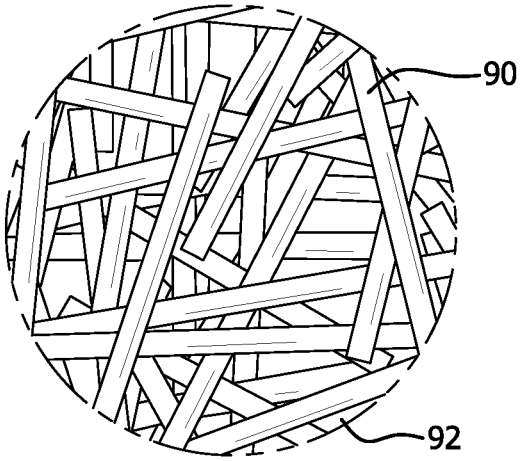
FIG. 13 is a plan view of discontinuous fibers in a polymer matrix.
Figure 14:
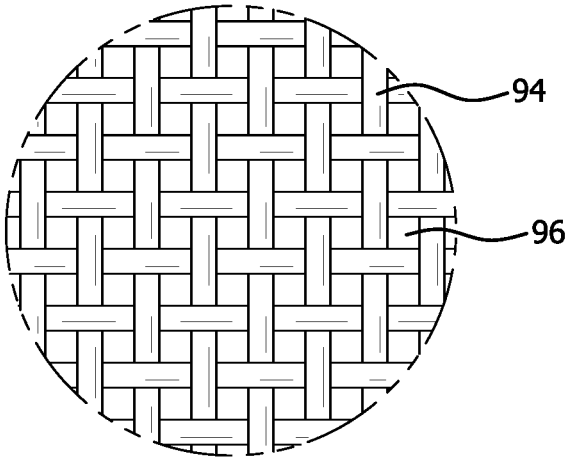
FIG. 14 is a plan view of woven fibers in a polymer matrix.

The wythe engagement members are preferably made of a strong, lightweight and corrosion resistant material. Such materials include fiber reinforced polymer. As shown in FIG. 13, discontinuous fibers 90 can be provided in a polymer matrix 92. As shown in FIG. 14, woven fibers 94 can be provided in a polymer matrix 96. Other continuous and discontinuous fiber reinforced polymer structures are possible.

The invention as shown in the drawings and described in detail herein disclose arrangements of elements of particular construction and configuration for illustrating preferred embodiments of structure and method of operation of the present invention. It is to be understood however, that elements of different construction and configuration and other arrangements thereof, other than those illustrated and described may be employed in accordance with the spirit of the invention, and such changes, alternations and modifications as would occur to those skilled in the art are considered to be within the scope of this invention as broadly defined in the appended claims. In addition, it is to be understood that the phraseology and terminology employed herein are for the purpose of description and should not be regarded as limiting.

We claim:

1. A stripping lifting insert for precast insulated panels having an insulating material layer between opposing wythes, the insulating material layer, wythes, and precast insulated panel having respective widths, the stripping lifting insert comprising:

an elongated connecting shaft having a shaft axis; and first and second spaced apart wythe engagement members connected to the connecting shaft in spaced apart relation to each other, each wythe engagement member comprising a hub and a plurality of three or more protrusions connected to and emanate from hub, each of the protrusions extending radially outward from the shaft axis;

wherein the wythe engagement members have a height less than the width of the wythes, whereby each wythe engagement member can be embedded in a respective wythe of the precast insulated panel.

2. The stripping lifting insert of claim 1, wherein the position of the wythe engagement members on the shaft is adjustable.

3. The stripping lifting insert of claim 2, wherein the hubs of the wythe engagement members have a threaded interior opening, and an outside surface of the shaft is cooperatively threaded such that the wythes can be engaged to the threaded shaft, and the position of the wythe engagement members on the threaded shaft can be adjusted by threading the wythe engagement members along the length of the shaft.

4. The article of claim 3, wherein the interior thread is at least one selected from the group consisting of triangular or trapezoidal threads.

5. The stripping lifting insert of claim 1, further comprising lift engagement structure secured to an end of the shaft for engaging a stripping lifting device.

6. The stripping lifting insert of claim 5, wherein the lift engagement structure is threaded and an end of the shaft is cooperatively threaded.

7. The stripping lifting insert of claim 1, wherein the plurality of protrusions comprises four equally spaced about the circumference of the hub.

8. The stripping lifting insert of claim 7, wherein the four protrusions are arranged in a cross configuration.

9. The stripping lifting insert of claim 1, wherein the wythe engagement members are made from a fiber-reinforced polymer.

10. The stripping lifting insert of claim 9, wherein the fiber-reinforced polymer comprises discontinuous fibers in a polymer matrix.

11. The stripping lifting insert of claim 10, wherein the fiber-reinforced polymer comprises, in the polymer matrix, continuous fibers and discontinuous fibers.

12. The stripping lifting insert of claim 10, wherein lengths of the discontinuous fibers are in a range of 0.2" to 2".

13. The stripping lifting insert of claim 9, wherein the fiber-reinforced polymer comprises at least one selected from the group consisting of glass fibers, carbon fibers, aramid fibers, basalt fibers, and combinations thereof in a matrix comprising at least one selected from the group consisting of thermoplastic polyphenylene sulfide, polyethylene terephthalate, polyamide, polyurethane, polysulfone, polyether ketone, polyetherether ketone, thermoset epoxy, phenolic, vinyl ester and polyester.

14. The stripping lifting insert of claim 9, wherein the fiber-reinforced polymer comprises at least one selected from the group consisting of glass fibers, carbon fibers, aramid fibers, basalt fibers, and combinations thereof, in a matrix of thermoplastic polyphenylene sulfide, polyethylene terephthalate, polyamide, polyurethane, polysulfone, polyether ketone, polyetherether ketone, thermoset epoxy, phenolic, vinyl ester and polyester.

15. The stripping lifting insert of claim 1, wherein a height of the stripping lifting insert along the shaft axis is in a range of 0.75" to 1.25", a radial extension of each protrusion of the plurality of protrusions is in a range of 2" to 8", a height of each protrusion of the plurality of protrusions along the shaft axis is in a range of from 1/16" to 1/4", a width of each protrusion of the plurality of protrusions orthogonal to a radial direction is in a range of from 0.5" to 1.5", and a diameter of the shaft is in a range of from 0.5" to 1.5".

16. The stripping lifting insert of claim 1, wherein each protrusion of the plurality of protrusions comprises respective ribs extending radially away from the hub.

17. The stripping lifting insert of claim 16, wherein each rib extends over 25% to 75% of the radial extension, and has a width of 20% to 60% of the width, of the corresponding protrusion.

18. A precast insulated panel, comprising:

an insulating material layer;

opposing wythes on each side of the insulating material layer, the insulating material layer, wythes, and precast insulated panel having respective widths;

a stripping lifting insert, comprising an elongated connecting shaft having a shaft axis, and first and second spaced apart wythe engagement members connected to the shaft in spaced apart relation to each other, each wythe engagement member comprising a hub and a plurality of three or more protrusions connected to and distributed around the hub, each of the protrusions extending radially outward from the shaft axis, wherein the wythe engagement members have a height less than the width of the wythes, whereby each wythe engagement member can be embedded in a respective wythe of the precast insulated panel, and wherein the connecting shaft has a length greater than the width of the precast insulated panel such that a connecting end of the connect shaft will protrude from one of the wythes.

19. The precast insulated panel of claim 18, wherein the position of the wythe engagement members on the shaft is adjustable.

20. The precast insulated panel of claim 18, further comprising lift engagement structure secured to an end of the shaft for engaging a stripping lifting device.

21. The precast insulated panel of claim 20, wherein the lift engagement structure is threaded and an end of the shaft is cooperatively threaded.

22. The precast insulated panel of claim 18, wherein the hubs of the wythe engagement members have a threaded interior opening, and an outside surface of the connecting shaft is cooperatively threaded such that the wythes can be engaged to the threaded shaft, and the position of the wythe engagement members on the threaded shaft can be adjusted by threading the wythe engagement members along the length of the shaft.

23. The precast insulated panel of claim 18, further comprising lift engagement structure secured to an end of the shaft for engaging a stripping lifting device.

24. The precast insulated panel of claim 23, wherein the lift engagement structure is threaded and an end of the shaft is cooperatively threaded.

25. The precast insulated panel of claim 18, wherein the plurality of protrusions comprises four equally spaced about the circumference of the hub.

26. The precast insulated panel of claim 25, wherein the four protrusions are arranged in a cross configuration.

27. The precast insulated panel of claim 18, wherein the wythe engagement members are made from a fiber-reinforced polymer.

28. The precast insulated panel of claim 27, wherein the fiber-reinforced polymer comprises at least one selected from the group consisting of continuous and discontinuous fibers, in a polymer matrix.

29. The precast insulated panel of claim 27, wherein the fiber-reinforced polymer comprises at least one selected from the group consisting of glass fibers, carbon fibers, aramid fibers, basalt fibers, and combinations thereof, in a matrix comprising at least one selected from the group consisting of thermoplastic polyphenylene sulfide, polyethylene terephthalate, polyamide, polyurethane, polysulfone, polyether ketone, polyetherether ketone, thermoset epoxy, phenolic, vinyl ester and polyester.

30. The precast insulated panel of claim 18, wherein each protrusion of the plurality of protrusions comprises respective ribs extending radially away from the hub, wherein each rib extends over 25% to 75% of the radial extension, and has a width of 20% to 60% of the width, of the corresponding protrusion.

31. A method of making a precast insulated panel having an insulating material layer between opposing wythes, comprising the steps of:

providing a stripping lifting insert, comprising an elongated connecting shaft having a shaft axis, and first and second spaced apart wythe engagement members connected to the shaft in spaced apart relation to each other, each wythe engagement member comprising a hub and a plurality of three or more protrusions connected to and distributed around the hub, each of the protrusions extending radially outward from the shaft axis, wherein the wythe engagement members have a height less than the width of the wythes, whereby each wythe engagement member can be embedded in a respective wythe of the precast insulated panel, and wherein the connecting shaft has a length greater than the width of the precast insulated panel such that a connecting end of the connect shaft will protrude from one of the wythes;

providing a mold for the precast insulated panel;

placing a first wythe engagement member into the mold;

pouring concrete constituting a portion of a first wythe into the mold such that the wythe engagement member is embedded within the concrete of the first wythe and the connecting shaft protrudes from the wythe;

positioning an insulation material layer over the wythe with the connecting shaft protruding from the insulation material layer;

positioning a second wythe engagement member onto the connecting shaft;

pouring concrete constituting a second wythe over the insulation material layer, with a second wythe engagement member embedded within the second wythe, and the connecting shaft protruding from the second wythe, to form a precast insulated panel;

connecting a lifting device to the elongated connecting shaft protruding from the second wythe, and lifting the precast insulated panel from the mold.

* * * * *